US011976430B2

(12) United States Patent
Allen

(10) Patent No.: US 11,976,430 B2
(45) Date of Patent: May 7, 2024

(54) CABLE BARRIER DELINEATOR

(71) Applicant: Nolda Ray Allen, Newton Falls, OH (US)

(72) Inventor: Nolda Ray Allen, Newton Falls, OH (US)

( * ) Notice: Subject to any disclaimer, the term of this patent is extended or adjusted under 35 U.S.C. 154(b) by 589 days.

(21) Appl. No.: 17/192,393

(22) Filed: Mar. 4, 2021

(65) Prior Publication Data

US 2022/0282437 A1 Sep. 8, 2022

(51) Int. Cl.

| | |
|---|---|
| ***E01F 9/669*** | (2016.01) |
| ***E01F 9/619*** | (2016.01) |
| ***E01F 15/06*** | (2006.01) |

(52) U.S. Cl.

CPC ..... *E01F 9/669* (2016.02); *E01F 9/619* (2016.02); *E01F 15/06* (2013.01)

(58) Field of Classification Search

CPC ..... E01F 9/669; E01F 9/619; E01F 15/06
See application file for complete search history.

(56) References Cited

U.S. PATENT DOCUMENTS

| | | | | |
|---|---|---|---|---|
| 3,564,984 A | | 2/1971 | Alexander | |
| 4,152,046 A | | 5/1979 | Knapp | |
| 4,249,832 A | * | 2/1981 | Schmanski | E01F 9/669 40/607.13 |
| 5,212,898 A | | 5/1993 | Dinan et al. | |
| 6,113,307 A | * | 9/2000 | Joyner, III | E01F 9/619 116/63 R |
| 6,956,502 B1 | | 10/2005 | Bartinelli | |
| 8,585,221 B2 | | 11/2013 | Allen et al. | |
| 2006/0081742 A1 | | 4/2006 | Garcia | |
| 2010/0061801 A1 | | 3/2010 | Heald | |
| 2013/0108362 A1 | * | 5/2013 | Philip | E01F 9/61 404/10 |

FOREIGN PATENT DOCUMENTS

| | | | | |
|---|---|---|---|---|
| WO | WO-2005040499 A1 | * | 5/2005 | E01F 15/06 |

* cited by examiner

*Primary Examiner* — Anita M King
(74) *Attorney, Agent, or Firm* — Harpman & Harpman

(57) ABSTRACT

A cable barrier delineator for selective attachment on roadway barrier cable systems that utilize steel cables between posts as a vehicle safety barrier along highways. The cable barrier delineator is a rectangular one-piece cable attachment having double sided reflective insert surfaces with a split apertured mounting tab for cable engagement extending therefrom. An attachment tab retainment tie stays selectively positioned through apertures in said mounting tabs, stabilizes and prevent unauthorized removal once installed and secured on the cable.

1 Claim, 3 Drawing Sheets

CABLE BARRIER DELINEATOR

BACKGROUND OF THE INVENTION

1. Technical Field

This invention relates to roadway cable barrier systems that utilize steel wire ropes mounted on multiple support posts. More specifically to reflective cable delineators mounted on steel wire cables to indicator the barrier is present.

Roadway barrier delineators are typically reflective devices that are mounted along the side of a highway or in the medium of a divided highway. Such delineators typically are reflective in nature allowing the guardrail to be distinguished along the side of the road by the passing motorists.

2. Description of Prior Art

Prior art is directed to cable barrier systems that provide roadside or medium safety barriers. Examples of such markers can be seen in U.S. Pat. Nos. 3,564,984, 4,152,046, 5,212,898, 6,956,502 and 8,585,221. U.S. Publications 2006/0081742 and 2010/0061801.

In U.S. Pat. No. 3,564,984 a highway marker can be seen having a brace secured to a guardrail and an extending upstanding reflector positioned thereon.

U.S. Pat. No. 4,152,046 discloses a light reflector delineator formed of a small radius arcuate configuration of a sphere or cylinder portion used to reflect light in mounting situations.

U.S. Pat. No. 5,212,890 claims a pole sign construction providing a dual sided display attachment for an upstanding pole associated with a road barrier.

U.S. Pat. No. 8,585,221 discloses an optical device that reflects back impinging light. The device has a reflective lens on a mounting support pole and display.

U.S. Publication 2006/0081742 discloses a guardrail reflective delineator mounting device to provide a secure mount for a safety reflective element on a metal guardrail.

Finally, U.S. Publication 2010/0061801 discloses a cable barrier delineator that attaches to the cable support posts with an upstanding armature having a rectangular reflector on its upper surface.

SUMMARY OF THE INVENTION

A bi-directional cable delineator for selective attachment to cable barrier installations that have multiple steel wire cables supported between posts as a roadway automobile restraint barrier. The cable delineator has bi-directional reflecting surfaces with an apertured cable engagement tab extending therefrom. The attachment tab is positioned on the cable and retained by an adjustable flexible tie so that the cable delineator hangs from the cable in a secure position. Highly reflective sheet material is applied to both sides of the delineator in recessed receiving surfaces providing a high reflective bi-directional cable delineator.

DETAILED DESCRIPTION OF THE INVENTION

Figure 1:
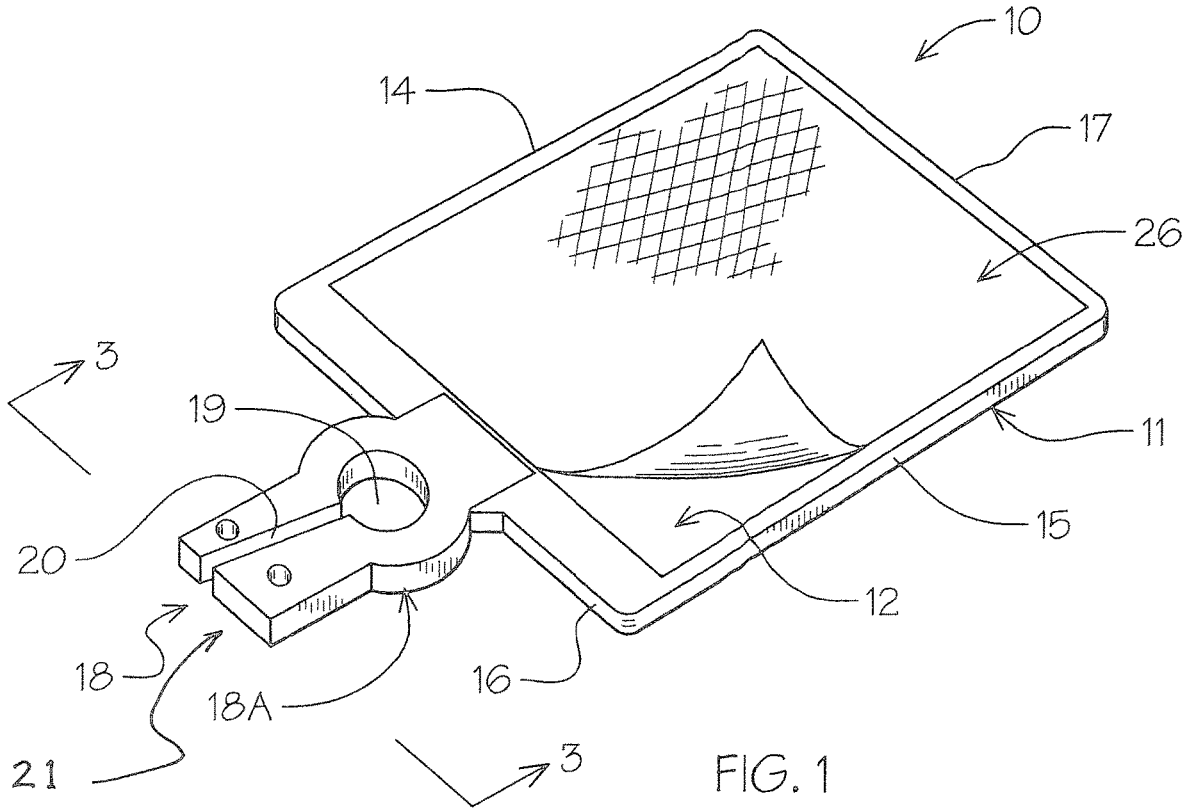
FIG. 1 is a front, side and end perspective view of the cable delineator of the invention.
Figure 2:
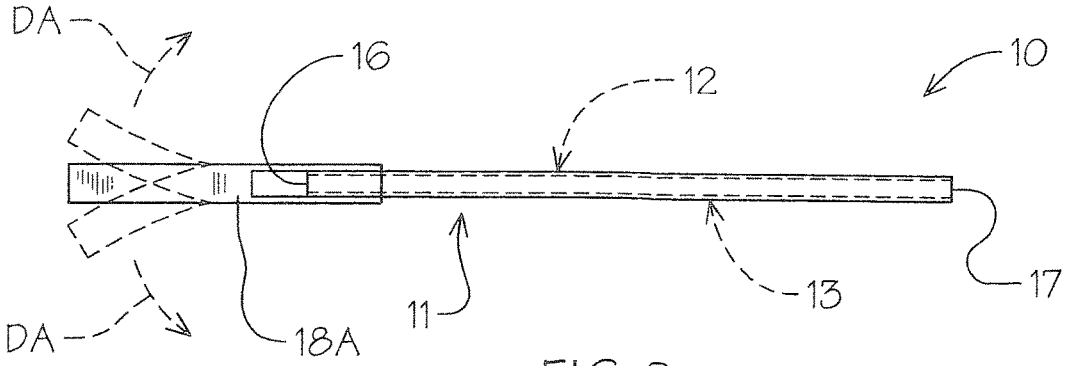
FIG. 2 is a side elevational view thereof.
Figure 3:
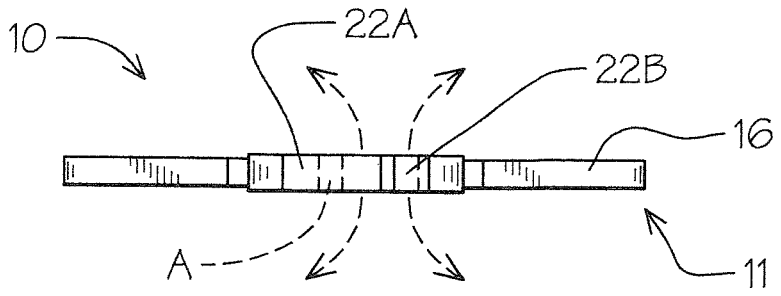
FIG. 3 is an end elevational view on lines 3-3 of FIG. 1.

Referring to FIGS. 1-3 of the drawings, the cable delineator 10 of the invention can be seen having a rectangular main body member 11 with oppositely disposed central recessed surface areas 12 and 13 therein. The main body member 11 is of a thin flat panel configuration as best seen in FIG. 2 of the drawings. The main body member 11 has spaced parallel oppositely disposed side edges 14 and 15 and interconnecting top and bottom edges 16 and 17 defining a generally rectangular configuration.

An apertured mounting tab 18 extends integrally from the top edge 16 with a proportionally increased edge thickness to that of the main body member. The mounting tab 18 has an area of increased transverse dimension at 18A with a cable receiving opening 19 positioned there within.

A slit 20 within the tab 18 extends longitudinally from the opening 19 to the tab's free end at 21 thereby defining elongated bifurcated deformable tab areas 22A and 22B. The slit 20 is angularly disposed so that the formed deformable tab areas 22A and 22B are of unequal transverse dimension best seen in FIGS. 1 and 4 of the drawings.

Figure 5:
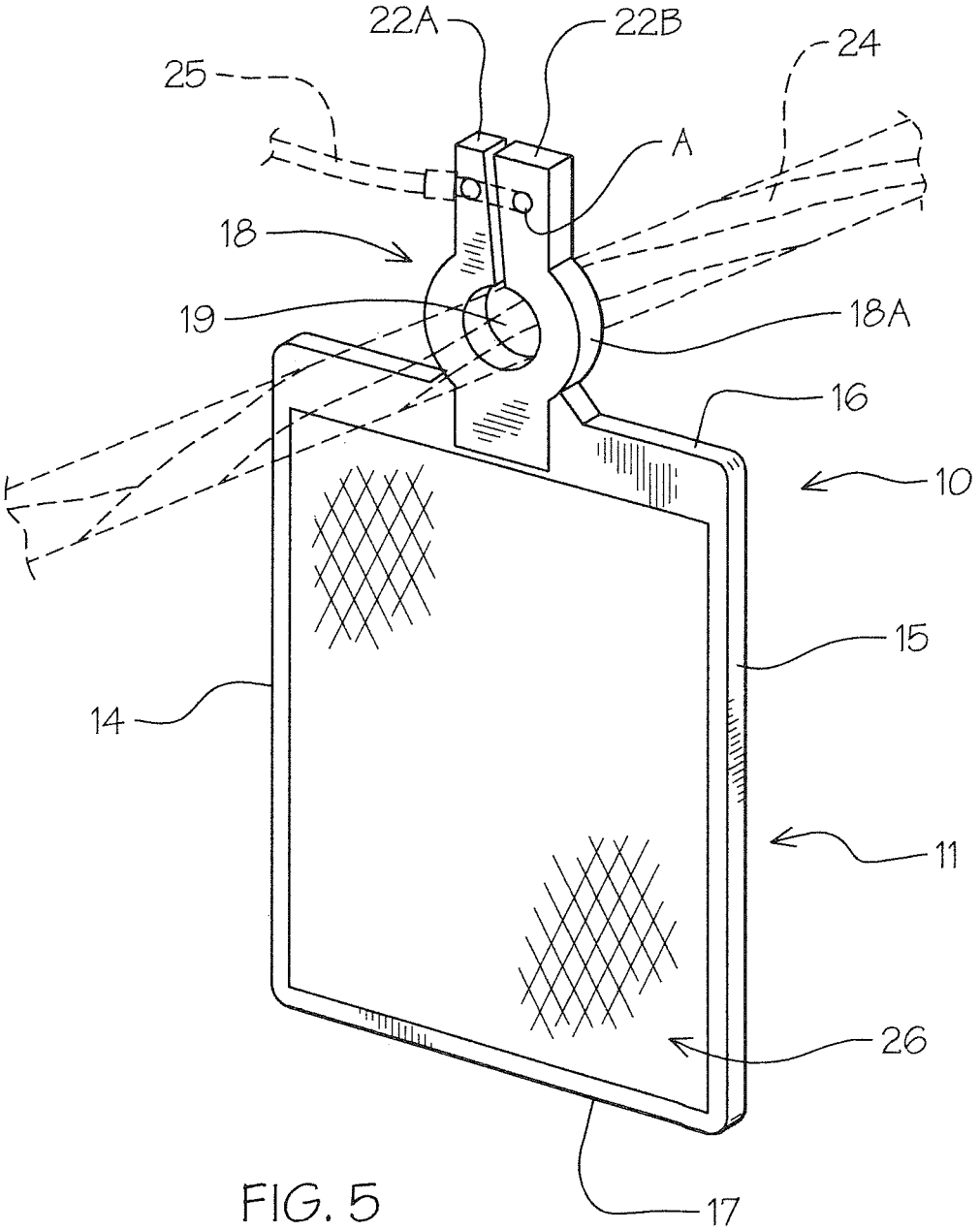
FIG. 5 is a perspective view of the cable delineator mounted on and hanging from a barrier cable with security tie shown in broken lines.

The tab portions 22A and 22B can thereby be deformed by external user applied hand pressure in respective translateral arcuate paths indicated by broken directional arrows DA as seen in FIG. 5 of the drawings and illustrated graphically by dotted lines in FIG. 2 of the drawings.

It will be evident that by the manual deflection of the respective tab portions 22A and 22B in opposite directions, it will allow the placement of the cable delineator 10 onto a steel wire rope cable 24 of the post and cable safety restraint system for vehicles as illustrated in FIG. 5 of the drawings.

Figure 4:
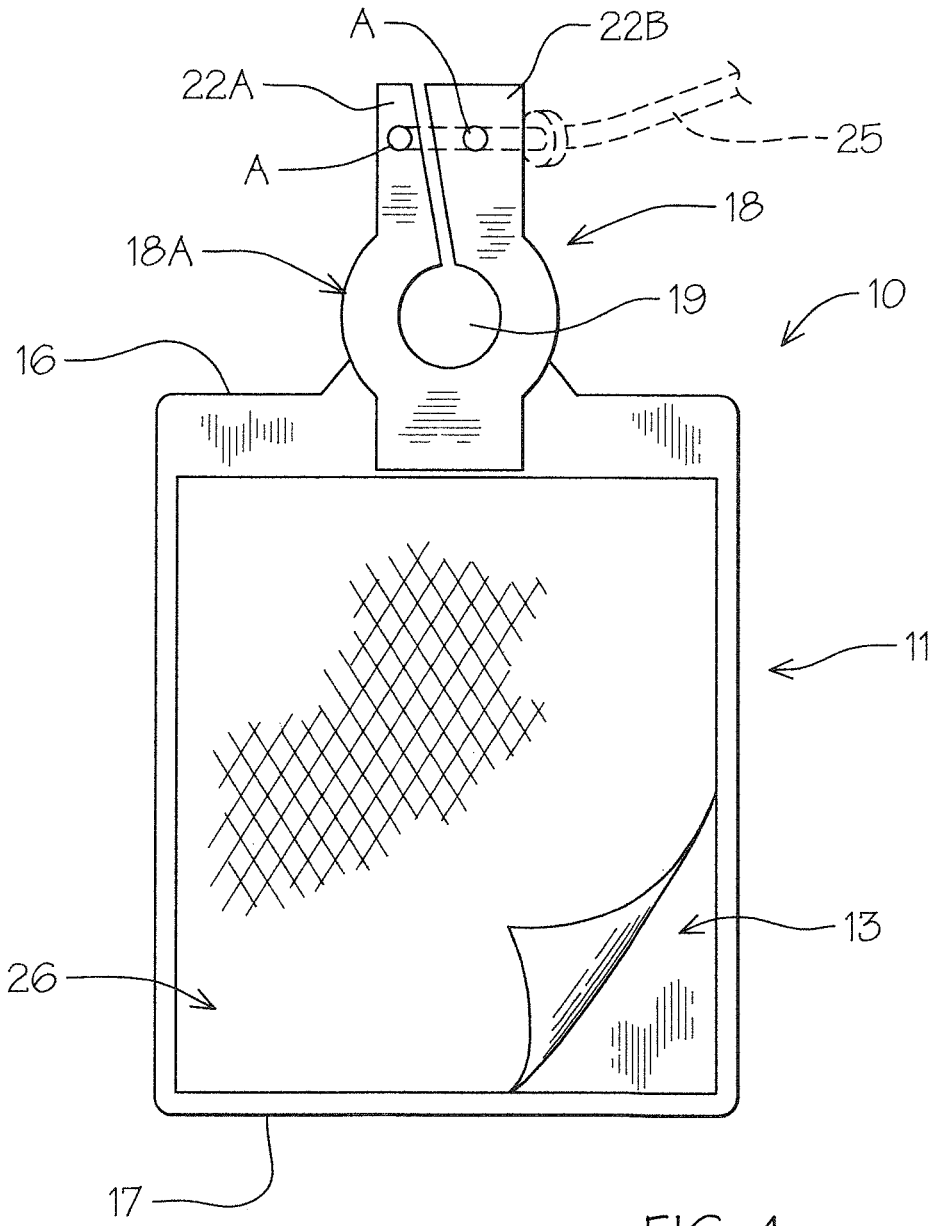
FIG. 4 is a back plan view thereof.

The respective tab end portions 22A and 22B each have a retainment aperture A inwardly from their free ends for receiving an adjustable plastic locking type tie 25 well known in the art and shown in broken lines in FIGS. 4 and 5 of the drawings. The locking tie 25 thus secures the cable delineator 10 onto the wire rope cable 24 restricting lateral movement there along and unauthorized removal.

The central recess areas 12 and 13 on opposite side surfaces of the main body 11 received, in this example, self-adhesive highly reflective sheet material 26, well known in the art. The recess areas 12 and 13 thereby provide both placement aids and surface abrasion protection for the reflective sheets 26.

It will be seen that the bifurcated mounting tab 18 increased edge dimensional thickness assures that the tab's ability to be safely deformed as hereinbefore described when mounting to the cable 24 imparting user durability and reduced chance of failure upon the required deformation.

The plastic locking tie 25, as noted, prevents the removal of the cable delineator 10 unless removed by deliberately cutting the tie 25. The cable delineator 10 is applied typically in spaced intervals along the cable 24 between the support posts, not shown, for maximum visibility in both daylight and night by illumination of the vehicle's headlights from both directions. The tab opening 19 allows the cable delineator 10 to be anywhere along the length of the cable 24 while its relatively large dual surface reflection area portions assure a maximum visual impact for its overall size.

It will be evident that this unique combination of size to reflective are and integrated mounting system reduces the cost to effectiveness ratio by providing the maximum bi-directional reflective surface at the lowest per unit cost achieved by a one-piece synthetic resin molded product.

It will be evident to those skilled in the art that various changes and modifications may be made therein without departing from the spirit of the invention.

Therefore I claim:

1. A cable delineator for steel cable of a post and cable barrier, said cable delineator comprising, a main body member having spaced parallel sides and interconnecting spaced parallel top and bottom edge surfaces, a front and rear reflective surface on a main body member, said reflective surface comprises reflective sheets secured to opposite sides thereof, a bifurcated apertured mounting tab extending from said body member for engagement on the steel cable defining a pair of deformable elongated tab portions of unequal transverse dimensions with a central opening therein, a pair of transversely aligned apertures inwardly of their respective tab portion free ends, and a locking tie selectively secured through said aligned apertures therein.

* * * * *